United States Patent [19]

Moon et al.

[11] 4,086,884

[45] May 2, 1978

[54] METHOD AND APPARATUS FOR CONTROLLING THE AMOUNT OF FUEL METERED INTO AN INTERNAL COMBUSTION ENGINE

[75] Inventors: Roger A. Moon, Ypsilanti; Frank J. Garofalo, Farmington Hills, both of Mich.

[73] Assignee: Ford Motor Company, Dearborn, Mich.

[21] Appl. No.: 695,880

[22] Filed: Jun. 14, 1976

[51] Int. Cl.[2] ..... F02B 3/00

[52] U.S. Cl. ..... 123/32 EB; 364/442

[58] Field of Search ..... 123/32 EA, 32 EB, 32 ED, 123/32 EC; 235/150.21

[56] References Cited

U.S. PATENT DOCUMENTS 3,991,727 11/1976 Kawai et al. ..... 123/32 EA

*Primary Examiner*—Samuel Feinberg

*Attorney, Agent, or Firm*—Robert W. Brown; Clifford L. Sadler

[57] ABSTRACT

Method and apparatus for controlling the amount of fuel metered to an internal combustion engine through electrically-controllable valve means, such as electromagnetic fuel injectors. The valve means delivers the fuel to the engine in a quantity that varies as a function of an electrical signal representing the mathematical product obtained by multiplying a binary number electrical signal by an electrical signal representing a condition of the engine. The binary number electrical signal is a coefficient of the engine-condition electrical signal and is calculated, by a programmed digital computer, from a function or functions describing a desired relationship between the coefficent value and various electrical signals representing variable conditions of engine operation. The binary number electrical signal is repetitively recalculated by the digital computer. However, the product electrical signal is generated continuously or at a rate greater than the rate at which the repetitive calculation of the binary number electrical signal takes place. Consequently, with respect to variations in the engine-condition electrical signal, the product electrical signal used to determine the amount of fuel metered to the engine is up-dated continuously or at a rate greater than that at which the digital computer updates the binary number electrical signal.

10 Claims, 5 Drawing Figures

+5V
22
10K
20
MC14528
48
52
154
10K
50
+5V
Rate Multiplier 26
CD4089
156
158
160
32
24
28
$M_1/K_2$ Latch 30
MC74C174
Ctr
Clk
Load
162
X
$Z^{11}$ $Z^{10}$ $Z^9$ $Z^8$ $Z^7$ $Z^6$
$Z^5$ $Z^4$ $Z^3$ $Z^2$ $Z^1$ $Z^0$
Binary Word $M_1/K_2$ From CPU
Binary Word $M_2/K_4$ From CPU
$M_2/K_4$ Latch 58
170
56
164
166
168
60
Rate Multiplier 54
$f_1$=640 KHz
68
172
174
176
72
86
$Z'9$ $Z'8$
$Z'7$ $Z'6$ $Z'5$ $Z'4$
$Z'3$ $Z'2$ $Z'1$ $Z'0$
Feedback Rate Multiplier 70

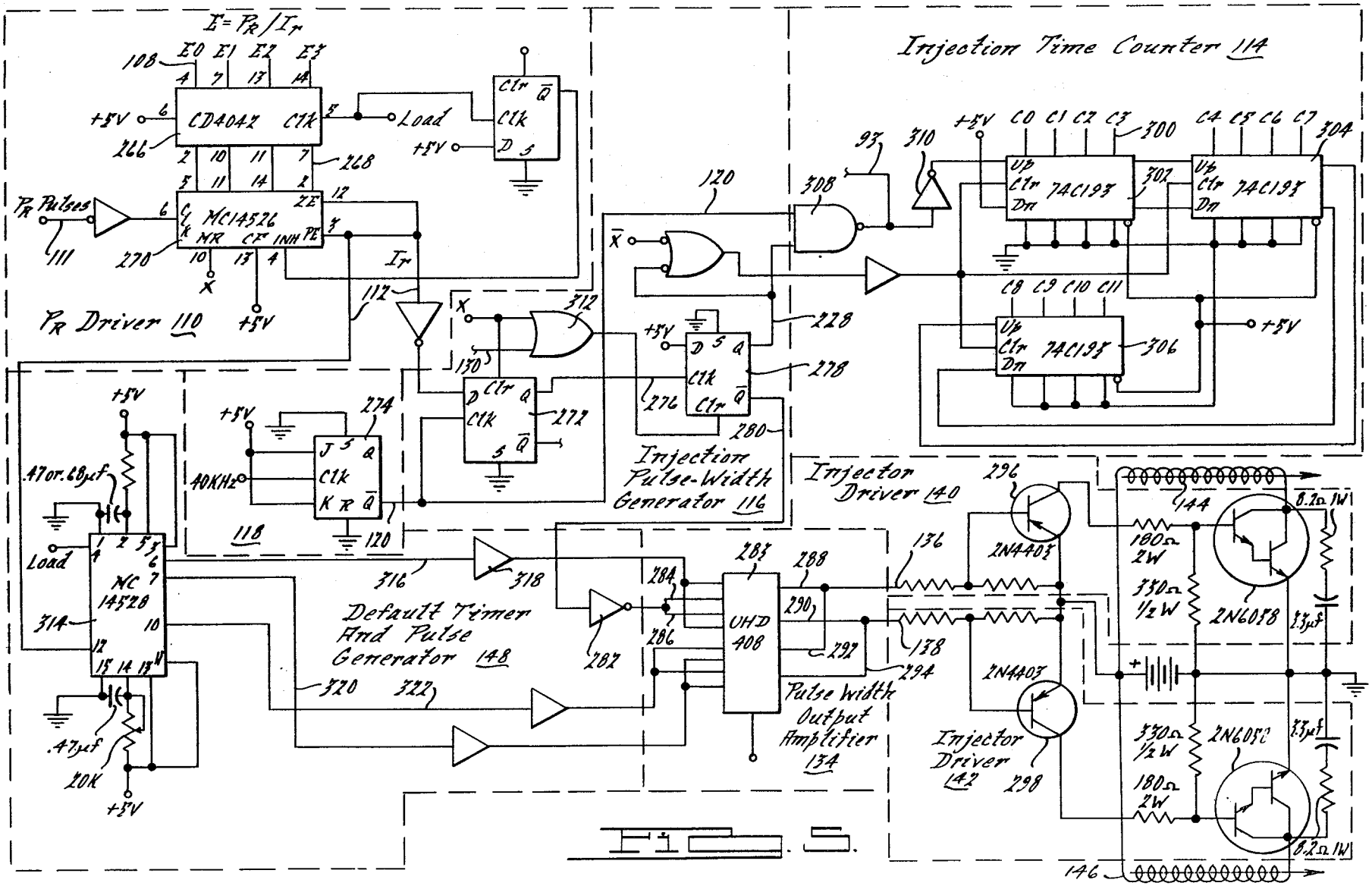
Injection Time Counter 114
74C193
Injector Driver 140
Injector Driver 142
2N6078
2N4403
Pulse Width Output Amplifier 134
UHD 408
Injection Pulse-Width Generator 116
Default Timer And Pulse Generator 148
CD4042
MC14526
MC 14528
Load
40KHz
$I_R$ Pulses
$I_R$ Driver 110
$I = I_R/I_T$

METHOD AND APPARATUS FOR CONTROLLING THE AMOUNT OF FUEL METERED INTO AN INTERNAL COMBUSTION ENGINE

BACKGROUND

This invention relates to a method and apparatus for controlling the amount of fuel metered, through electrically-controllable valve means, to an internal combustion engine.

As used herein, the term "binary number" means a number represented by a plurality of bits of information having either of two states.

A "Method and Apparatus for Engine Control" is described in U.S. patent application Ser. No. 423,968 filed Dec. 12, 1973 in the names of D. F. Moyer, S. S. Devlin and R. J. Genik, now U.S. Pat. No. 3,696,614. The engine control system described in this patent employs a digital computer to calculate arithmetically and repetitively values corresponding to settings of means for controlling the engine spark timing, the exhaust gas recirculation (EGR) valve and the amount of fuel metered to the engine. The digital computer calculates the values for these controlled variables arithmetically from algebraic functions describing desired relationships between the controlled variables and various engine operating conditions. Preferably, the relationships between the controlled variables and changing engine conditions take into account the interaction of the controlled variables, thereby, to achieve ,those conditions of control that result in stable engine operation. The settings of the controlled variables are updated repetitively, for example, every 30 milliseconds (ms) or every quarter-revolution of the engine crankshaft.

A digital microprocessor and memory system, using MOS technology with a 12-bit data and address format, was used in reducing the present invention to practice. This system is currently commercially available in Japan from the Tokyo Shibaura Electric Company of Japan. This company, however, is undertaking a new MOS 12-bit microprocessor design that is expected to be commercially available in the United States in the latter part of 1976. The new design is the microprocessor preferred for use in the practice of the present invention. Of course, other known microprocessors or minicomputers using different bit numbers could be used in a system operating according to the principles hereinafter described, among which are: the System-User-Engineering minicomputer of the Lockheed Electronics Company described in its publication entitled, "SUE Computer Handbook"; the Intel Corporation 8080; the Motorola 6800; the Fairchild F8; and the Rockwell PPS-8. Also, microprocessors are currently available from Texas Instruments, Inc., National Semiconductor Corp., Advanced Micro Devices and Siemens in both 8-bit and 16-bit versions.

In the microprocessor and associated logic circuits used in an engine control system of the type described in the Moyer et al patent, a substantial amount of computer time may be required to carry out the programmed computer calculations, and the time between updates of the calculated computer output values may be on the order of 30 ms. In an eight-cylinder, four-cycle internal combustion engine operating at 3,000 rpm, a combustion process takes place in one of the eight cylinders every five ms. Thus, between computer updates, there may be as many as six spark firings intended to produce combustion in an engine cylinder.

During transient engine operating conditions, the air-fuel ratio of the mixture supplied to the engine cylinders may be such that misfires occur or poor or improperly timed combustion takes place.

The amount of fuel supplied to an engine at any instant, according to most engine control philosophies now in use, should be in the amount necessary to provide a substantially stoichiometric air-fuel ratio in the mixture supplied to each cylinder. In an engine control system employing a digital computer, any of several available designs of electrically-controllable valve means may be used to control the supply of fuel to the engine. For example, an electronically-controlled carburetor may be used or electromagnetic fuel injectors may be provided, one for each cylinder, and the fuel may be injected into the intake manifold just upstream of the intake valve for each of the engine cylinders. Alternatively, electromagnetic fuel injectors may be positioned within a central throttle body and fuel injected into the intake manifold or throttle body at a location upstream of all of the passages leading to the intake valves for the various engine cylinders.

Fuel injection systems that utilize electromagnetic fuel injectors control the fuel delivery to the engine by varying the width of the electrical pulse applied to each of the fuel injectors. The longer the pulse width, the greater is the amount of fuel delivered through the injector into the engine. The systems or controllers used to determine the fuel injector pulse width fall into either of two categories, the speed-density controller or the mass air-flow controller. The speed-density controller uses the absolute pressure within the intake manifold of the internal combustion engine in conjunction with the engine speed and other engine operating condition variables, such as engine temperature, atmospheric pressure, atmospheric temperature, etc., to determine indirectly the mass air flow into the engine. The mass air-flow controller directly measures the air flow into the intake manifold of the internal combustion engine and adjusts the fuel injector pulse width accordingly.

Internal combustion engines of recent design incorporate exhaust gas recirculation (EGR) to reduce the level of nitrogen oxide exhaust emissions. Typical prior-art fuel-metering systems of the speed-density type calibrate the fuel delivery system for some assumed and fixed EGR rate. However, it is desirable that the EGR flow rate be taken into account in determining the amount of fuel to be supplied to the engine, particularly during transient conditions.

SUMMARY OF THE INVENTION

In an internal combustion engine operating in the steady-state, the air-fuel ratio (A/F) is the ratio of the mass flow rate of air into the engine to the mass flow rate of fuel into the engine, or, in such an engine equipped with EGR:

$$A/F = \frac{(\text{Air Mass Flow Rate} + \textit{EGR}\ \text{Mass Flow Rate}) - (\textit{EGR}\ \text{Mass Flow Rate})}{(\text{Fuel Mass Flow Rate})} \quad (1)$$

where the term "(Air Mass Flow Rate + EGR Mass Flow Rate)" is the mass flow rate of the gaseous constituents in the intake manifold of an internal combustion engine. Equation (1) is particularly applicable to a speed-density fuel control system and its numerator is the mass air-flow rate into the engine, a quantity that may be obtained more directly in a mass-flow fuel control system.

In a fuel-injected internal combustion engine having exhaust gas recirculation employing a sonic EGR valve, such as is described in U.S. patent application Ser. No. 502,523 filed Sept. 3, 1974 in the name of Warren F. Kaufman and entitled "Engine Exhaust Gas Recirculating Control", equation (1) may be mathematically expressed as follows:

$$A/F = 14.64\lambda = \frac{\frac{\eta v\, ND}{2} - \frac{HP_eA_t}{\sqrt{Te}}}{\frac{I_r}{2}\, nNA_o(W-A_1)} \quad (2)$$

where the elements in the expression are defined as follows:

$\lambda$ = the equivalence ratio, that is, the actual air/fuel ratio divided by the stoichiometric air/fuel ratio;
14.64 = the assumed stoichiometric air/fuel ratio;
$\eta_v$ = the specific volumetric efficiency referenced to the pressure and temperature conditions in the engine intake manifold;
$\rho$ = density of the constituents in the intake manifold;
$N$ = engine speed in revolutions per unit time;
$D$ = engine displacement;
$A_t$ = EGR-valve throat area;
$P_e$ = EGR-valve upstream pressure;
$T_e$ = EGR-valve upstream temperature;

$$H = \sqrt{\frac{\gamma}{R}\left(\frac{2}{\gamma+1}\right)^{\frac{\gamma+1}{\gamma-1}}}$$

= sonic mass flow constant for the EGR valve where R is the ideal gas constant and is the ratio of specific heats for exhaust gas;
$A_o$ = fuel delivery rate, in mass per unit time, of a single fuel injector;
$n$ = number of injectors;
$I_r$ = injection repetition rate, that is, the number of injections from each fuel injector per complete engine cycle (two crankshaft revolutions in a four-cycle engine);
$W$ = pulse width per injection in units of time
$A_1$ = pulse width offset in units of time Equation (2) may be algebraically rearranged as follows:

$$W = \frac{\eta_v \rho D}{14.64\lambda I_r nA_o} - \frac{HP_eA_t}{7.32\lambda I_r nNA_o\sqrt{T_e}} + A_1 \quad (3)$$

However, the density $\rho$ of the gaseous mixture in the intake manifold may be expressed as follows:

$$\rho = GP_m/RT_m \quad (4)$$

where $G$ is the molecular weight equivalent of the gaseous mixture in the intake manifold, $P_m$ is the intake manifold absolute pressure, $R$ is the molecular weight equivalent gas constant for the intake manifold mixture and $T_m$ is the intake manifold absolute temperature. The molecular weight equivalent $G$ and the gas constant $R$ may be assumed to have values, respectively, of 28.95 lbm per lbm molecular weight equivalent and 1545.5 ft.-lbf. per lbm molecular weight equivalent Rankin degree.

When equation (4) is substituted in equation (3), the equation for injection pulse width W becomes:

$$W = \frac{\eta_v GD}{14.64\,\lambda I_r nA_oRT_m}[P_m] - \frac{HP_e}{7.32\lambda I_r nNA_o\sqrt{T_e}}[A_t] + A_1 \quad (5)$$

or $$W = M_1P_m - M_2A_t + A_1 \quad (6)$$

where $M_1$, represents the coefficient of the manifold pressure $P_m$ and $M_2$ represents the coefficient of the EGR-valve throat area $A_t$ in equation (5), or, $$M_1 = \frac{\eta_v GD}{14.64\lambda I_r nA_oRT_m} \quad (7)$$

and $$M_2 = \frac{HP_e}{7.32\lambda I_r nNA_o\sqrt{T_e}} \quad (8)$$

In accordance with the method and with the apparatus of the invention, the amount of fuel metered to an internal combustion engine is controlled. A plurality of electrical signals, each of the signals being indicative of a condition of the engine as of a selected instant in time during which the engine is in operation, are generated. In the preferred form of the invention, a digital computer (microprocessor and associated memory) is used to calculate one or more coefficient values, for example, the values of $M_1$ and $M_2$ of equations (7) and (8) above. The plurality of electrical signals are used in calculating the coefficient value or values. If the values for $M_1$ and $M_2$ are to be calculated, the plurality of engine condition electrical signals represent those factors in equations (7) and (8) which are considered to be variables of engine operation. The calculated coefficient values are transferred periodically from the digital computer as binary number output electrical signals. While the engine is in operation, the aforementioned steps are continually repeated, that is, the coefficient values are repetitively recalculated and made available as binary number outputs of the digital computer.

An electrical circuit, coupled between the digital computer and the electrically controllable valve means used to meter fuel to the internal combustion engine, multiplies the binary number electrical signals representative of the coefficient values by electrical signals representative of conditions of the engine, thereby, to obtain product electrical signals. These product electrical signals may represent the products $M_1P_m$ and and $M_2A_t$. The electrical circuit then may be used to determine the difference between the first-mentioned product electrical signal $M_1P_m$ and the second product electrical signal $M_2A_t$, and the fuel injection offset $A_1$ may be added to the difference, the result of this calculation being the fuel injection pulse width W according to equation (6) above.

The intake manifold pressure $P_m$ and the EGR-valve throat area $A_t$ are parameters that change rapidly during transient engine operating conditions. These digital computer calculations of the coefficients $M_1$ and $M_2$ may be repeated, for example, every 30 ms, but between these calculations, it is desirable to modify the fuel control signal for changes that may have occurred in the rapidly varying parameters. According to the invention, the multiplication of the $M_1$ and $M_2$ coefficients by the $P_m$ and $A_t$ parameters, respectively, is done continuously or at a rate greater than the rate at which the $M_1$ and $M_2$ coefficients are updated by repeated computer calculation.

In equations (7) and (8), it should be noted that many of the various factors in their right-hand terms may be treated either as constants or variables. The molecular weight equivalent G of the constituents of the engine's intake manifold may change as a function of their water vapor content, the vehicle geographical location or the amount of EGR. This variation may be regarded as negligible and G treated as a constant, or the digital computer may take into account variations in G when calculating the coefficient $M_1$. Similarly, the injection repetition rate per engine cycle $I_r$ may be fixed in a given engine fuel metering control system, as may the number of injectors N, or these numbers may be varied during engine operation. The injectors may be grouped so that all injectors are energized simultaneously or so that only one, two or four are energized at the same time. The parameter R in equation (7) is not a constant, but varies somewhat as a function of the mixture in the intake manifold at any given time and as a function of pressure and temperature conditions existing at such time. Also taken into account may be the variations in the stoichiometric air/fuel ratio, assumed to be 14.64 in equations (7) and (8), which occur due to differences in the fuel supplied by different refiners or supplied by a single refiner at various times of the year or in various geographical locations. Moreover, it should be noted that the computer calculations defined by equations (7) and (8) permit the computer and other circuitry utilized in practicing the invention to be adapted to various engine types and fuel control philosophies, without modification of the electronic circuitry other than adjustment of the computer program to take into account changes in the various factors in equations (7) and (8).

One or more fuel injectors or other electrically-controllable fuel metering devices may be used to meter fuel into the engine's intake manifold or into a throttle body preferably located at the central point, such as the entrance to the intake manifold, on the engine. Alternatively, the fuel control system may employ individual metering devices for each of the engine's cylinders or combinations thereof.

Equations (1) through (8) apply to a speed-density internal combustion engine control system employing A/F ratio control by the variation of fuel-injection pulse width. The principles of the invention, however, may be utilized in a fuel metering system that directly measures the volumetric flow rate of the air entering the engine intake manifold and that modifies this volumetric air flow rate to account for variations in air density, thereby, to produce a signal representative of mass air flow rate, and that then supplies fuel according to the mass air flow rate into the engine. Where a system of this type is used, a volumetric air flow rate signal may be continually multiplied by a coefficient representing the density of the air being inducted into the engine and may include factors intended to take into account variations of parameters such as fuel delivery rate, number of fuel injectors utilized, injections per engine cycle, desired air/fuel ratio, which may be other than stoichiometric, fuel characteristics, etc. The coefficient by which the volumetric air flow rate signal would be multiplied would be calculated repeatedly by the digital computer at uniform intervals of time or degrees of engine crankshaft rotation.

Whether the engine control system is of the speed-density or of the mass air flow type, it may be necessary to modify the coefficient values calculated by the digital computer by the application to them of scaling (calibration) factors that may be desirable to improve the operation of, or to reduce the complexity of, the hardware components in the engine control system.

The invention may be better understood by reference to the detailed description which follows and to the drawings.

BRIEF DESCRIPTION OF THE DRAWINGS

FIG. 5 is a schematic electrical diagram of two divider circuits, an injection pulse-width generator, an injection time counter, a pulse-width output amplifier, two injector-driver circuits and a default timer and pulse generator circuit shown in block form in FIG. 1.

In FIGS. 2 through 5, the items corresponding to those shown in block form in FIG. 1 are enclosed by broken lines and the circuitry within the broken lines is identified by a numeral corresponding to the block in FIG. 1 or by both name and numeral identifying the circuit. Also, like numerals refer to like items throughout the several figures. In the detailed schematic electrical diagrams, component type numbers and values and signal frequency values have been provided by way of example and not limitation.

DETAILED DESCRIPTION

Figure 1:
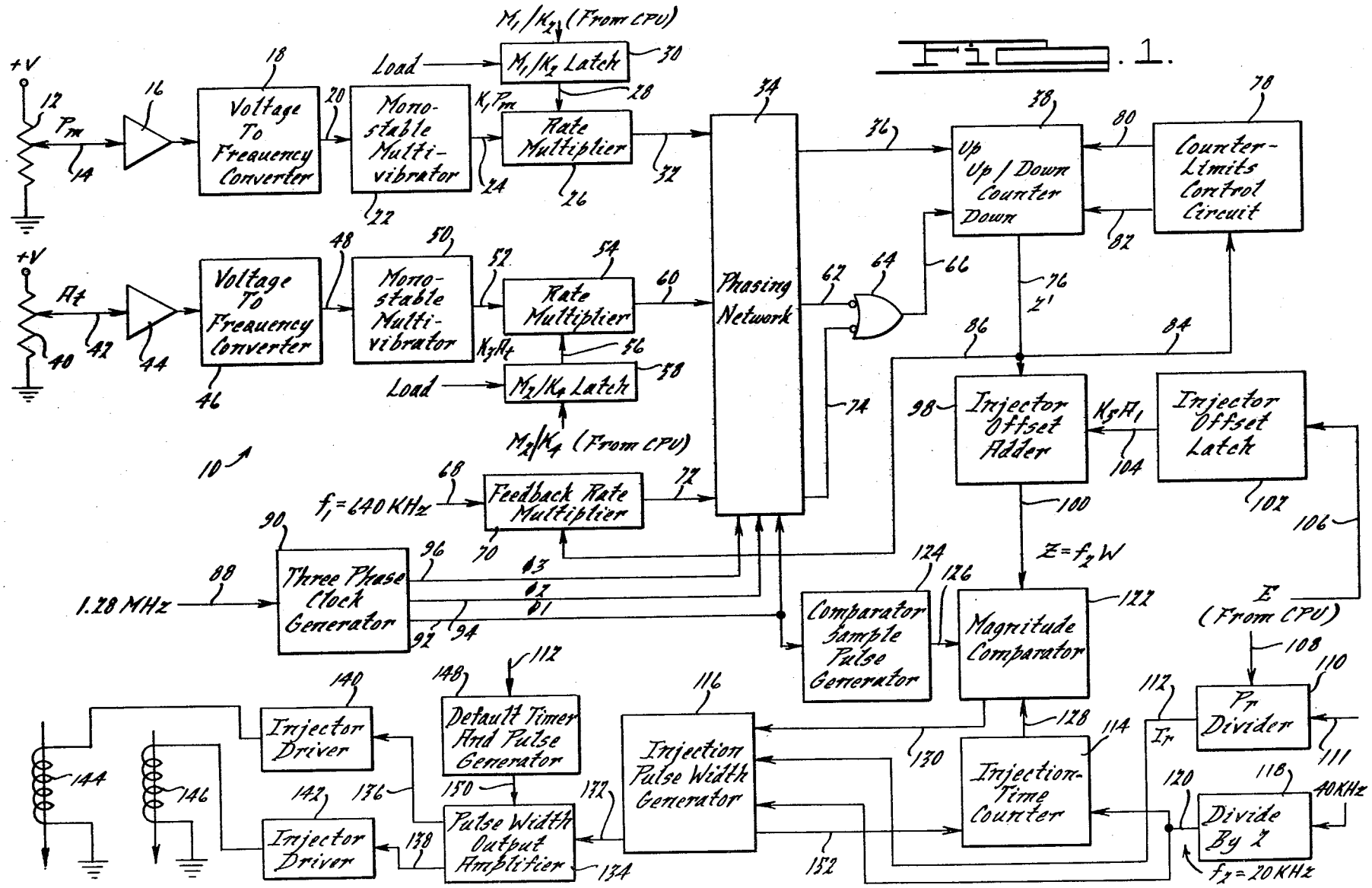
FIG. 1 is an electrical block diagram of apparatus that may be utilized in practicing the method of the invention.

With particular reference to FIG. 1, there is shown a schematic diagram of apparatus that may be utilized in practicing the method of the invention as applied to the speed-density control of the fuel supply to a multi-combustion-chamber, fuel-injected internal combustion engine. This apparatus is generally designated by the numeral 10 and includes means 12, which may be a potentiometer connected across a reference voltage source and having a movable arm 14, for providing an electrical signal $P_m$ proportional to the absolute pressure in the intake manifold of the engine. The signal $P_m$ is amplified by an amplifier 16 whose output is applied to a voltage-to-frequency coverter 18. The converter output 20 is supplied to a monostable multivibrator 22. The output of the multivibrator 22 appears on its lead 24 and consists of a series of pulses having a pulse repetition frequency (PRF) proportional to the intake manifold absolute pressure $P_m$.

Similarly, means 40, which again may be a potentiometer having a movable arm 42, generates an electrical signal $A_t$ which is proportional to the throat area of a sonic-flow EGR valve that may be of the type described in the previously mentioned Kaufman patent. The electrical signal having a voltage proportional to EGR-valve throat area $A_t$ is supplied to an amplifier 44 whose output is supplied to a voltage-to-frequency converter 46 having an output 48 that is supplied to a monostable multivibrator 50 to produce on its output lead 52 a PRF proportional to the EGR throat area $A_t$.

The signal on lead 24 has a PRF equal to $K_1P_m$, where $K_1$ is a scaling factor between the absolute manifold pressure $P_m$ and the actual signal frequency appearing on lead 24. Similarly, the signal on lead 52 has a PRF equal to $K_3A_t$, where $K_3$ is a scaling factor. The PRF signal $K_1P_m$ forms one input to a rate multiplier 26, which has a second input 28 on which a binary number electrical signal appears. This binary number electrical signal is equal to $M_1/K_2$, where $M_1$ is defined in equation (7) and $K_2$ is a scaling factor. The binary number signal $M_1/K_2$ is obtained from a latch 30. The latch 30 is controlled by a digital computer central processing unit (CPU), which calculates the quantity $M_1/K_2$. This calculation may be updated or repeated, and the binary number in the latch 30 changed as a result, at uniform intervals of time, such as every 30 ms., or at uniform intervals of engine crankshaft rotation or as otherwise desired. In a similar manner, the signal on lead 52 having a PRF equal to $K_3A_t$ is suppliedas one input to a rate multiplier 54, which has a second input 56 on which a binary number electrical signal $M_2/K_4$ appears, where $M_2$ is defined by equation (8) and $K_4$ is a scaling factor. The binary number electrical signal $M_2/K_4$ is obtained from a latch 58, which receives its repeatedly updated input $M_2/K_4$ from the digital computer CPU.

The binary rate multipliers 26 and 54, as well as the binary rate multiplier 70, hereinafter described, may be commercially available integrated circuit devices. As described in Application Report Bulletin CA-160 entitled "SN7497 Binary Rate Multiplier" published by the Components Group of Texas Instruments, Inc., a binary rate multiplier is a device capable of producing at its output a signal $r_{out} = Xr_n/2^b$, where $r_{out}$ is the PRF of the output signal, X is a binary number input to the binary rate multiplier, $r_n$ is the PRF of the input signal and $b$ is a number of binary input bits available in the binary rate multiplier. Thus, the signal at the output lead 32 of the rate multiplier 26 has a PRF equal to $(K_1/K_2)(M_1)(P_m)/2^b$. Similarly, the output lead 60 from binary rate multiplier 54 has a signal having a PRF equal to $(K_3/K_4)(M_2)(A_t)/2^b$.

The signal 32 from the rate multiplier 26 is supplied, through a phasing network 34 and a lead 36, to the up-input of an up/down counter 38. The signal on output lead 60 from the rate multiplier 54 is supplied, through the phasing network 34, to a lead 62 forming one input to a gate 64 having an output lead 66 connected to the down-input of the up/down counter 38. A frequency $f_1$ is supplied on the input lead 68 to a feedback binary rate multiplier 70 having an output lead 72 connected through the phasing network 34 to a lead 74 forming the other input to the gate 64.

The output of the up/down counter 38 is a binary number electrical signal appearing on its output leads 76. This binary word signal, identified as Z', is supplied to a counter- limits control circuit 78 via leads 84. The counter-limits control circuit 78 has output leads 80 and 82 connected to the counter 38 to control the maximum and minimum count permitted to appear as a binary number on the lead 76 of the counter. This binary number electrical signal Z' also is supplied via leads 86 to the feedback binary rate multiplier 70 and constitutes its binary number electrical signal input. The signal appearing on output 72 of the feedback binary rate multiplier 70 has a PRF equal to $f_1Z'/2^b$. It is assumed that all of the rate multipliers 26, 54 and 70 accommodate the same number of bits $b$ at their binary inputs.

A clock signal, which may be 1.28 MHz, is supplied on an input lead 88 to a three-phase clock generator circuit 90 having output leads 92, 94 and 96 on which clock signals having phases $\phi 1$, $\phi 2$ and $\phi 3$, respectively, appear. These signals control the phasing network 34 so that pulse signals corresponding to those on leads 32, 60 and 72 appear on the respectively corresponding leads 36, 62 and 74 at times appropriately spaced to ensure that each of these pulses either produces an increment or a decrement in the counter. In other words, the phasing network prevents coincident occurrence of the pulses appearing on leads 36, 62 and 74.

With the Z' binary number electrical signal being supplied to the feedback rate multiplier 70, the binary number signal Z' attains a state such that the rate at which pulses appear at the up-input of the binary counter 38 equals the rate at which pulses appear at its down-input. This may be mathematically expressed as follows:

$$(K_1/K_2)(M_1)(P_m)/2^b = (K_3/K_4)(M_2)(A_t)/2^b + (f_1Z')/2^b \tag{9}$$

or $$Z' = [(K_1/K_2)(M_1)(P_m) - (K_3/K_4)(M_2)(A)]/f_1 \tag{10}$$

Equation 10 should be compared with equation (6) previously given, from which it may be seen that equation (10) does not include the term $A_1$ and instead includes the various scaling factors and the frequency factor $f_1$.

The term $A_1$ in equation (6) is a fuel injector pulse width offset term that takes into account the fuel delivery delay between the application of an electrical potential to the coil of an electromagnetic fuel injector and the actual occurrence of fuel flow and also may take into account variations in injector fuel delivery rate as a function of injector energization time. In the apparatus of FIG. 1, the signal Z' on leads 76 is supplied to an injector offset adder 98 which has an output 100 on which appears a binary number electrical signal equal to the sum of the binary number electrical signal Z' and $K_5A_1$, where $K_5$ is a scaling factor. The binary number signal $K_5A_1$ appears at the output of an injector offset latch 102 having an input 106 comprising a portion of a signal E obtained from the digital computer CPU. The signal E is a computer word which, for example, may consist of 12 bits, the first four of which may be supplied on a lead 108 to a $P_r$ divider circuit 110, for a purpose hereinafter described. The next seven of the 12 bits may represent the binary number electrical signal $K_5A_1$, and the twelfth bit of the signal E may be unused.

The signal appearing on output leads 100 from the injector offset adder is a binary number electrical signal $Z$ defined as follows:

$$Z = f_2W' = \frac{\left(\frac{K_1}{K_2}\right)(M_1)(P_m) - \left(\frac{K_3}{K_4}\right)(M_2)(A_t)}{f_1} + K_5A_1 \tag{11}$$

where $f_2$ is a frequency factor hereinafter described. In equation (11), W' is equal to the fuel injection pulse width W as defined by equation (6) if $K_1/K_2 = K_3/K_4 = f_1f_2$ and if $K_5 = f_2$. In such case, equation (11) becomes:

$$Z = f_2W' = f_2W = f_2[(M_1)(P_m) - (M_2)(A_t) + (A_1)] \quad (12)$$

The $P_R$ divider 110 has an input lead 111 on which $P_R$ pulses occur. Preferably, these pulses are generated in the manner described in the aforementioned Moyer et al patent and have a PRF proportional to the engine angular velocity and are indicative of engine crankshaft position. The output lead 112 of the $P_R$ divider has a signal appearing on it having a PRF, of $I_r$, which is the injection repetition rate as previously defined. The pulses, $I_r$ occurring on lead 112 are supplied to an injector pulse-width generator 116, which initiates fuel injection from electromagnetic fuel injectors or injector groups 114 and 146, which are simultaneously energized by injector drive circuits 140 and 142. The injector drivers 140 and 142 are controlled, respectively, by signals appearing on output leads 136 and 138 of a pulse-width output amplifier 134 controlled by a signal on an output lead 132 of the injector pulse-width generator 116.

When the injector pulse-width generator 116 receives an injection pulse $I_r$, a signal is applied via a lead 152 to an injection-time counter 114. The signal transmitted on the lead 152 to the injection-time counter 114 enables this counter to receive pulses at the frequency $f_2$, preferably equal to 20 KHz, that appear on output lead 120 of a divide-by-two circuit 118 supplied with 40 KHz clock pulses. A magnitude comparator 122 has inputs consisting of the binary number electrical signal Z appearing on leads 100 and a binary number electrical signal that appears on leads 128 and represents the count stored in the injection-time counter 114. A comparator sample-pulse generator 124 produces signals, on lead 126 coupled to the magnitude comparator, that repeatedly cause the comparator to compare the binary number electrical signal Z with the count stored in the counter 114. When the count is equal to the binary number Z, a signal is transmitted via output 130 to the injection pulse-width generator 116. This terminates and prevents further fuel delivery from the injectors 144 and 146 until the occurrence of the next injection repetition pulse $I_r$ on the lead 112.

The circuit of FIG. 1 includes a default timer and pulse generator 148 having the injection pulses $I_r$ appearing on lead 112 as its input. The output lead 150 from the circuit 148 is supplied to the pulse-width output amplifier 134. If the digital computer fails to load the binary number inputs into the rate multipliers 26 and 54 with predetermined regularity, the circuit 148 causes the pulse-width output amplifier 134 to produce fixed-duration output pulses on the leads 136 and 138 to energize the fuel injectors 144 and 146 for lengths of time sufficient to maintain the engine in operation.

The detailed circuit diagrams in FIGS. 2 through 5 and the description which follows together more fully describe the method of the invention and the implementation of the apparatus illustrated in block form in FIG. 1. The circuits of FIGS. 2 through 5 have been constructed and tested in engine control applications and have been found to be very satisfactory, but have not been optimized from the standpoint of minimization of the number of circuit components. Preferably, the circuitry in FIGS. 2 through 5 would be redesigned to provide the described functions in a single large-scale integrated circuit for performing the various logic functions and for controlling the electromagnetic fuel injectors and their amplifier and driver circuits. Also, in FIGS. 2 through 5 a number of gate elements have terminals identified by either the symbol X or $\overline{X}$; these symbols represent complementary clearing pulses supplied by the digital computer CPU at times when power to the engine control system is turned on or when the computer calculations are for some reason restarted The signal represented by X is normally low and clears the gates when high, whereas the signal $\overline{X}$ is normally high and clears when low.

Figure 2:
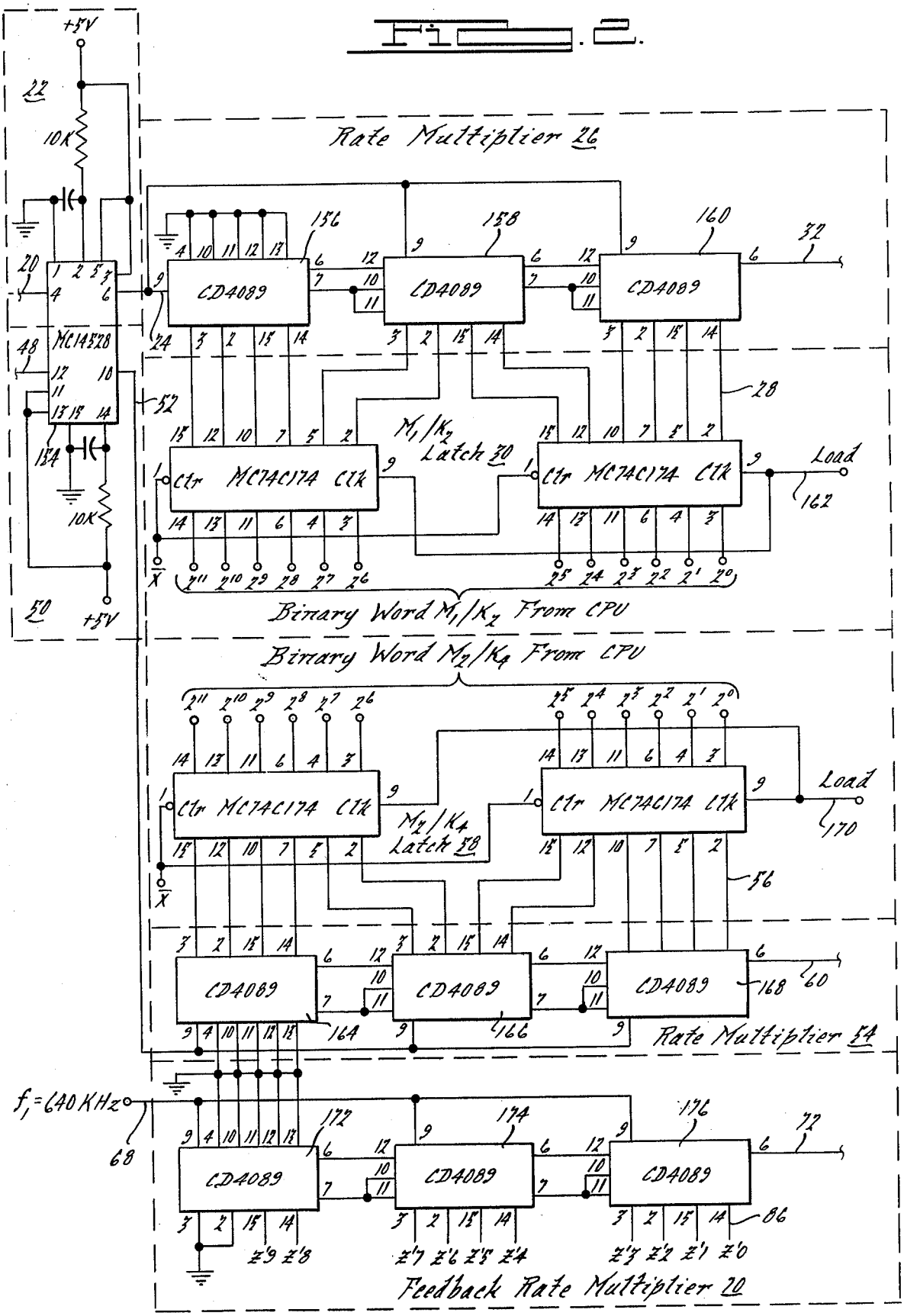
FIG. 2 is a schematic electrical diagram of three rate multipliers and two latch circuits illustrated in block form in FIG. 1.

With particular reference now to FIG. 2, there are shown the multivibrators 22 and 50 formed by resistors and capacitors coupled to a dual monostable-multivibrator integrated-circuit package 154. The output lead 24 from monostable multivibrator 22 is supplied as the rate input to three RCA type CD4089 four-bit rate multipliers 156, 158 and 160. A twelve-bit binary number electrical signal, having a value $M_1/K_2$ as calculated by the digital computer CPU, forms the input to the $M_1/K_2$ latch 30. A load signal from the CPU, appearing on a lead 162, transfers the $M_1/K_2$ word from the CPU to the output leads 28 of the latch 30, and as a result the binary number $M_1/K_2$ forms the binary number input to the binary rate multiplier 26. Thus, the signal appearing on the output lead 32 from the rate multiplier 26 is a pulse train having an average PRF equal to $(K_1/K_2)(M_2)(P_m)$ divided by $2^{12}$ where 12 is the number of bits that can be accommodated in the input to rate multiplier 26.

The signal appearing on output lead 52 from the monostable multivibrator 50 is supplied as the rate input to the rate multiplier 54, which consists of cascaded binary rate multipliers 164, 166 and 168. The signal on input lead 52 has a PRF equal to $K_3A_t$. The binary word or number equal to $M_2/K_4$ and generated by the digital computer CPU is supplied as the input to the $M_2/K_4$ latch 58 having output leads 56 to which the 12-bit $M_2/K_4$ binary number signal is transferred upon the occurrence of a load signal on lead 170. The signal appearing on lead 60, forming the output of the rate multiplier 54, has an average PRF equal to $(K_3/K_4)(M_2)(A_t)$ divided by $2^{12}$, where 12 again is the number of bits that can be accommodated in the binary number input to the rate multiplier 54.

Figure 4:
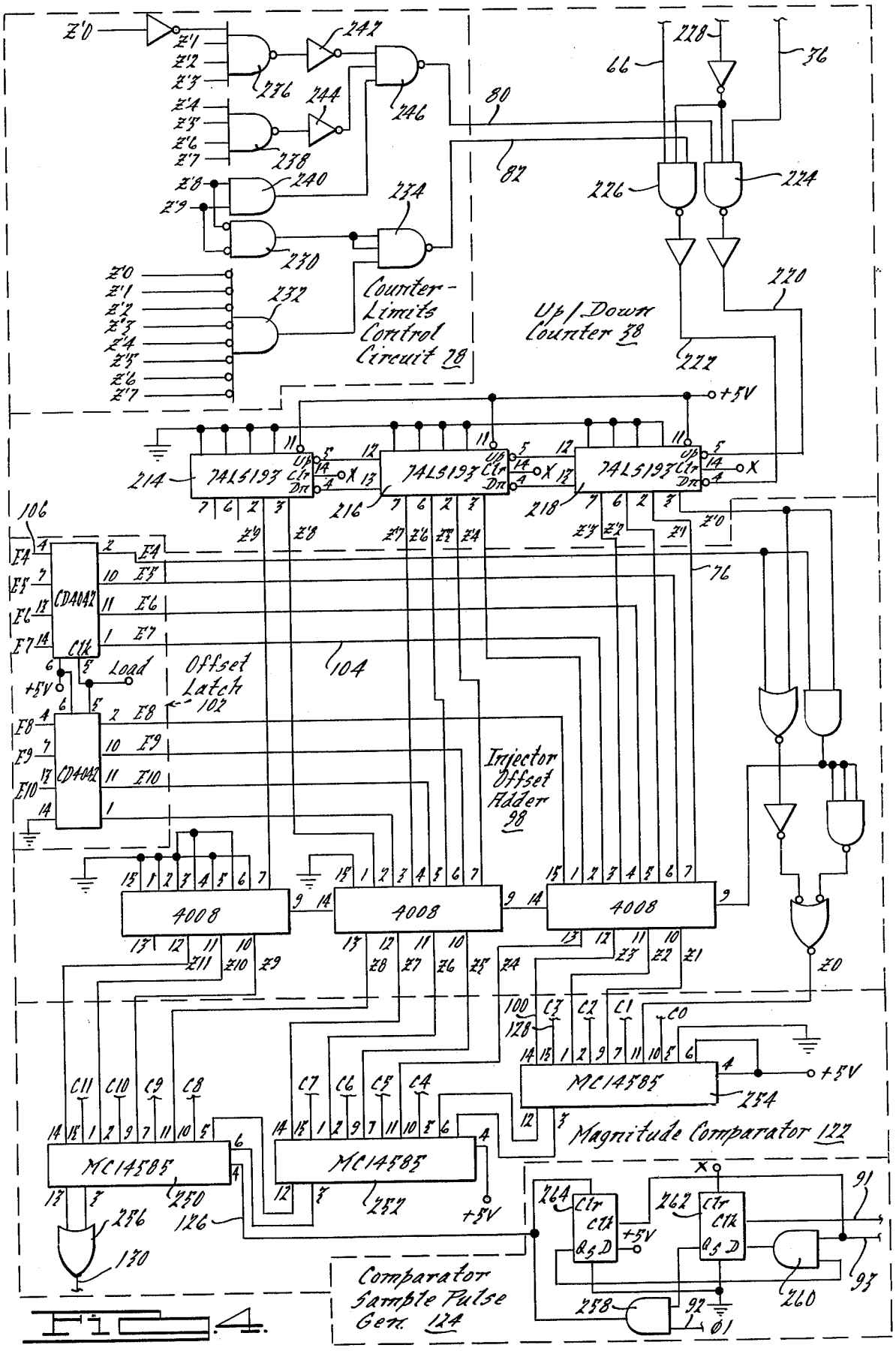
FIG. 4 is a schematic electrical diagram of a counter-limits control circuit, an up/down counter, an injector offset adder, an offset latch, a magnitude comparator and a comparator sample pulse generator illustrated in block form in FIG. 1.

The feedback rate multiplier 70 has as its rate input a clock pulse signal having a frequency $f_1$ equal to 640 KHz. The rate multiplier 70 is formed from three cascaded binary rate multipliers 172, 174 and 176 and has the output lead 72. The binary number input signal applied to the leads 86 of the feedback rate multiplier 70 is the binary number Z' produced on the output leads 76 of the counter 38, as shown in FIG. 4. The Z' signal in the embodiment described herein consists of 10 bits; these 10 bits, Z'0 through Z'9, are applied to the ten least-significant bit positions of the rate multiplier 70, the two most-significant bit positions of which are connected to the ground. The output signal appearing on lead 72 has an average PRF equal to $Z'f_1/2^{12}$.

Figure 3:
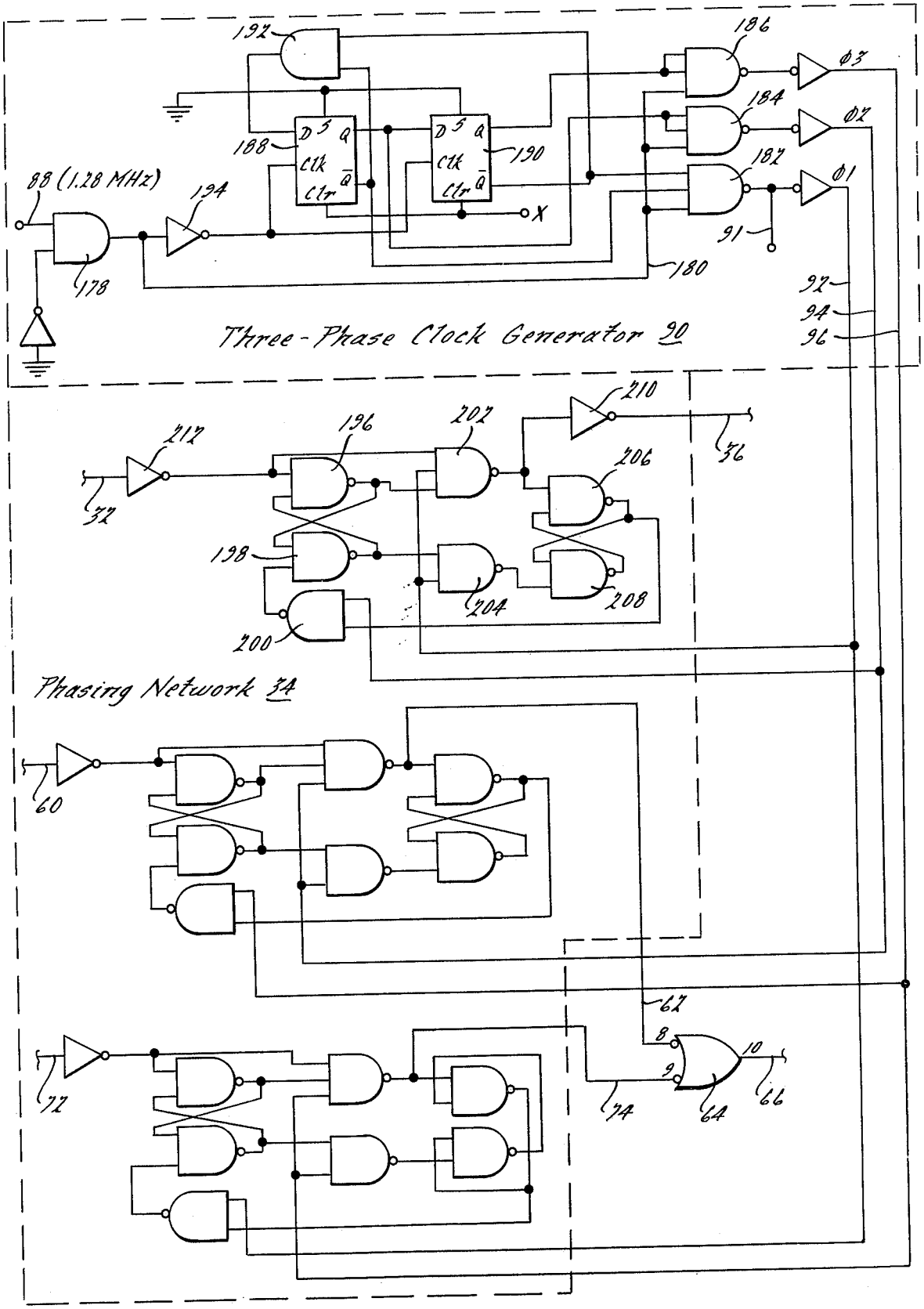
FIG. 3 is a schematic electrical diagram of a phasing network and three-phase clock generator circuit shown in block form in FIG. 1 and includes a gate shown in FIG. 1.

With particular reference now to FIG. 3, there are shown the three-phase clock generator circuit 90, the phasing network 34 and associated gate 64. The three-phase clock generator circuit 90 is supplied with a 1.28 MHz clock signal on its input lead 88 connected to a buffer AND-gate 178. Preferably, the signal applied to input lead 88 is obtained from a clock-signal-generating circuit in the digital computer.

The function of the three-phase clock generator circuit is to produce the phase-separated, but identical PRF, signals $\phi 1$, $\phi 2$ and $\phi 3$ on the output leads 92, 94 and 96, respectively, of the circuit 90. The PRF of these three signals is one-third the PRF of the signal on the input lead 88, the function of the circuit 90 being to sequentially channel the input pulses to the three leads, 92, 94 and 96 so that one out of every three input pulses appears on each of these output leads. Thus, the output of the buffer gate 178 is connected by a lead 180 to each of the inputs of gates 182, 184 and 186. The other inputs to each of these gates are obtained from the Q and $\overline{Q}$ outputs of type-D flip-flops 188 and 190, with which an AND-gate 192 also is associated. The output of AND-gate 192 is connected to the D-input of the flip-flop 188. The clock input to this flip-flop is obtained from the output of an inverter 194 supplied with the input clock pulses from buffer gate 178. The PRF of the phasing signals $\phi 1$, $\phi 2$ and $\phi 3$ preferably is substantially greater than the maximum PRF of any of the signals appearing on the output leaes 32, 60 and 72 from the rate multipliers 26, 54 and 70.

The phasing signals $\phi 1$, $\phi 2$ and $\phi 3$ are supplied to the phasing network 34, which comprises three identical circuits. Each of these circuits consists of seven NAND-gates and two inverters. For example, the phasing-network circuitry associated with the output lead 32 from the rate multiplier 26 includes NAND-gates 196, 198, 200, 202, 204, 206 and 208 and further includes inverters 210 and 212. The phasing signal $\phi 1$ is supplied as one of the inputs to each of NAND-gates 202 and 204 and the phasing signal $\phi 2$ is supplied as an input to the NAND-gate 200. These components function such that one pulse appears on the output lead 36, which is connected to the up-counting input of the up/down counter 38, every time a $\phi 1$ pulse occurs following the negative-going edge of a pulse appearing on lead 32. Similarly, pulses appear on the lead 62 when the negative-going edge of a pulse on the input lead 60 is followed by a $\phi 2$ pulse. Also, a pulse appears on the lead 74 when the negative-going edge of a pulse on input lead 72 is followed by a $\phi 3$ pulse.

Each time a negative-going edge of a pulse appears on either lead 62 or 74, a pulse is produced on lead 66 connected to the down-counting input of the up/down counter 38.

With particular reference now to FIG. 4, there is shown the up/down counter circuit 38, the counter-limits control circuit 78, the injector offset adder 98, the injector offset latch 102, the magnitude comparator 122 and the comparator sample pulse generator 124.

The up/down counter 38 includes four-bit binary counters 214, 216, 218 cascaded to provide a 12-bit counting capability. Only ten bits of this counting capability are utilized to produce the output count on leads 76. This output count appears on the leads Z'0 through Z'9, where the former is the least significant bit and the latter the most significant bit. Low logic-level pulses applied to the up-counting lead 220 to the counting unit 128 increase the count on output leads 76, and low logic-level pulses applied to the down-counting input to the counting unit 218 reduce the count appearing on output leads 76. The up-count results from pulses appearing on leads 36, which forms one of the inputs to a NAND-gate 224. The average pulse repetition frequency of the signal on lead 36 is $(K_1/K_2)(M_1)(P_m)$ divided by $2^{12}$. The pulses producing a down-count are those appearing on lead 66, which forms one of the inputs to a NAND-gate 226. Lead 66 is the output lead from the gate 64, and the pulses occurring thereon have a PRF equal to the sum of the pulse rates on the gate input leads 62 and 74, or, the PRF of the signal 66 is equal to $(K_3/K_4)(M_2)(A_t)$ divided by $2^{12}$. The net result of the up and down counting that occurs in the counter 38 is a binary number signal Z' defined according to equation (10) previously given. This binary number Z' appears on the leads 76 of the counter.

Input lead 228 to the up/down counter 38 comes from the identically numbered lead in the injection pulse-width generator circuit 116 (FIG. 5). The signal on this lead is used to inhibit the counter 38, thereby, to prevent a change in the binary number signal Z' during the time that the fuel injectors are energized, that is, during the time that the injection time counter 114 is accumulating a count, to be compared with Z', at a rate determined by the PRF of the signal $f_2$.

Leads 80 and 82 from the counter-limits control circuit 78 normally carry high logic-level signals, as does the lead 228, so that the NAND-gates 224 and 226 can pass pulses appearing on their respective input leads 36 and 66 as these pulses occur. Low-level signals on leads 80 and 82 inhibit, respectively, the NAND-gates 224 and 226 if the binary number output signal Z' reaches predetermined limits. Thus, if all of the bits of the Z' signal are low logic-level signals, the gates 230 and 232 produce high logic-level signals at their outputs causing a gate 234 to produce a low logic-level at its output 82. This inhibits the gate 226 and prevents further down-counting of the counter 38. On the other hand, when all of the nine most significant bits of Z' are at a high logic-level and the least significant bit, Z'0 is at a low logic-level, gates 236, 238 and 240 produce signals at their output which, through inverters 242 and 244 and gate 246, result in the appearance of the low logic-level signal on the lead 80. This signal inhibits the gate 224 and prevents further up-counting of the counter 38.

The injector offset adder 98 receives the Z' signal from the counter 38 and adds to this binary number Z' the binary number represented by the seven-bit signal appearing on output leads 104 of the injector offset latch 102. This signal is supplied to the latch 102 as seven bits of the computer word E, as was previously described. These seven bits represent the quantity $(K_5)(A_1)$, and are used to compensate the fuel injection pulse width for delays in fuel delivery from the injectors. The output of the injector offset adder appears on leads 100 and is the quantity Z defined in equation (11).

The magnitude comparator 122 includes three four-bit cascaded type MC14585 integrated circuit magnitude comparators 250, 252 and 254 and several gates interconnected to produce the Z'0 bit at their output. Under the control of the comparator sample pulse generator 124, the magnitude comparator 122 compares the twelve-bit Z binary number with another 12-bit binary number C, having bits C0 through C11, which represents the count stored in the injection time counter 114. The comparison by the magnitude comparator 122 occurs each time a pulse appears on the output lead 126 from the comparator sample pulse generator 124. If the binary number C from the injection time counter is greater than or equal to the binary number Z, then a pulse appears at the output lead 130 of a gate 256 in the magnitude comparator.

The function of the comparator sample pulse generator 124 is to cause the magnitude comparator 122 to make a comparison of the binary numbers Z and C each time one of the pulses in the signal $f_2$ occurs, these pulses being supplied to the injection time counter to increase the count represented by the binary number C. The comparator sample pulse generator causes the magnitude comparator to make a comparison on the occurrence of the first $\phi 1$ phase-timing pulse to appear on lead 92 subsequent to a pulse of the signal $f_2$. However, the comparison is made only during the time that the fuel injectors are energized.

In the comparator sample pulse generator 124, there are included gates 258 and 260 and type-D flip-flops 262 and 264. The signal appearing on input lead 93 to the gate 260 has a PRF corresponding to the PRF of the signal $f_2$, but appears on lead 93 only during the time intervals during which the fuel injectors are energized. The signal on lead 93 is obtained from the injection time counter 144. The signal appearing on lead 91 connected to the clock-input of the flip-flop 262 is the complement of the phase-timing signal $\phi 1$ occurring on lead 92. At the output 126 of the comparator sample pulse generator, a high logic level pulse occurs each time a $\phi 1$ timing pulse occurs concurrently with a pulse on input lead 93.

With particular reference now to FIG. 5, there is shown the $P_R$ divider circuit 110, the injection time counter 114, the injection pulse-width generator 116, the divide-by-two circuit 118, the default timer and pulse generator 148 and the pulse-width output amplifier 134 controlling the injector driver circuits 140 and 142, which are associated with fuel injectors or injector groups 144 and 146.

The $P_R$ divider circuit 110 receives $P_R$ pulses which, preferably, are generated at the rate of four per revolution of the engine crankshaft in an eight-cylinder, four-cycle internal combustion engine. The manner in which pulses may be generated is described in the previously-pulses occur in the number of eight per engine cycle, an engine cycle including two crankshaft revolutions, or at the rate of one $P_R$ pulse for each combustion chamber per engine cycle. The output pulses from the $P_R$ divider appear on lead 112 and are the signal identified as $I_r$, the PRF of which determines the number of injections per engine cycle. The digital computer CPU supplies four bits of the 12-bit signal E to the input leads 108 of a latch 266, which transfers these four bits to its output leads 268 upon the occurrence of a load signal on its pin 5. The four bits preferably represent the ratio $P_R/I_r$. This number is supplied to a programmable divide-by-N four-bit counter 270. Thus, the $P_R$ pulses occurring on input lead 111 are divided by $P_R/I_r$ so that the output from the counter 270 is a signal on lead 112 having a PRF equal to $I_r$, the desired injection rate.

The occurrence of an $I_r$ pulse on lead 112 initiates energization of the fuel injectors. These pulses on lead 112 are supplied to the D-input of a type-D flip-flop 272 in the injection pulse-width generator circuit 116. The clock input to this flip-flop is obtained as the $\overline{Q}$ output appearing on lead 120 of a flip-flop 274 in the divide-by-two circuit 118. The JK flip-flop 274 divides the 40 KHz frequency to produce the 20 KHz signal $f_2$ on lead 120. The first of these pulses on lead 120 to occur subsequent to the appearance of an $I_r$ pulse on the D-input of the flip-flop 272 causes the $I_r$ pulse to be transferred to the Q-output of flip-flop 272. This pulse, appearing on lead 276 and, is applied to the clock-input of a type-D flip-flop 278 and, as a result, the high-logic level signal applied to the D-input of flip-flop 278 is transferred to its Q output and its $\overline{Q}$ output on lead 280 is inverted by an inverter 282 and is applied to the inputs 284 and 286 of a uHD 408 integrated circuit manufactured by the Sprague Electric Company. This device includes four identical circuits each of which includes a dual-input AND-gate controlling the base-emitter current supplied to an NPN transistor having a grounded emitter and an open collector. The collector leads to the four circuits are connected, respectively, to leads 288, 290, 292 and 294.

In the absence of a circuit default, leads 288 and 292 are effectively connected to ground potential, through the transistors in the integrated circuit 283, whenever the signal on lead 280 from the injection pulse-width generator 116 is at a low logic-level. This causes current to flow through the emitter-base circuits of the drive transistors 296 and 298 in the injector driver circuits 140 and 142, respectively. Energization of these transistors renders the 2N6058 Darlington transistors conductive, which then allow current flow through the electromagnetic fuel injectors of fuel injector groups 144 and 146. In the arrangement herein depicted, the fuel injectors are energized simultaneously, although they may be energized in separate groups by circuit modifications easily accomplished by one of ordinary skill in the art. Also, the injection repetition-rate signal $I_r$ appearing on lead 112 may be changed during engine operation so that the number of injections per engine cycle varies as may be desired during engine operation. Of course, the binary number Z in such case would be adjusted, as required, by computer modification of the binary numbers supplied to the rate multipliers 26 and 54. Alternatively, the frequency $f_2$ could be modified. Also, the fuel injectors or injector groups 144 and 146 may be separately energized, rather than simultaneously energized, or a separately energized injector may be provided for each combustion chamber in the engine. In this latter case, the injectors could be sequentially energized. This may be accomplished by modification of the binary number electrical signal appearing on leads 108 to the $P_R$ divider circuit 110 and by use of logic circuitry, such as that described in the aforementioned Moyer et al patent, able to produce sequential injector energization for predetermined time intervals.

The fuel injectors or fuel injector groups 144 and 146 remain energized until the magnitude comparator 122 provides a high logic-level signal on the lead 130 in the injection pulse-width generator 116. This pulse signal occurs when the binary number C on leads 300 in the injection time counter 114 equals the binary number Z appearing on leads 100.

The injection time counter 114 includes cascaded four-bit binary up/down counters 302, 304 and 306. Lead 120 is connected to one input of a NAND-gate 308 and the 20 KHz pulses of signal $f_2$ appear thereon. THe signal on lead 228, which during the fuel injection periods has a high logic level and is obtained at the Q-output of the flip-flop 278 in the injection pulse-width generator 116, is applied to the other input of the NAND-gate 308 so that the complement of the $f_2$ pulses on lead 120 appear at the output of this NAND-gate and then are inverted by an inverter 310, thereby, to increase the count in the injection time counter. This continues until the resulting binary number C is equal to the binary number Z, at which time the pulse on lead 130 in the injection pulse-width generator circuit 116 results in a high logic-level signal at the output of an OR-gate 312. This high logic-level signal clears the flip-flop 278 so that its Q-output is set at a low logic-level and its $\overline{Q}$-output is set at a high logic-level. The high logic-level on the $\overline{Q}$-output lead 280 terminates energization of the fuel injectors.

The default timer and pulse generator 148 is designed to provide fuel injection energization pulses of 2 ms duration, sufficient to keep an engine running, in the event a default condition is detected in the computer or its associated circuitry. The circuit 148 includes a dual monostable multivibrator 314 having an input "load" signal which is the pulse signal used to load the binary number inputs of the rate multipliers 26 and 54. This load input retriggers the dual monostable multivibrator continuously so long as the load pulses continue and results in a continuous high logic-level signal on lead 316. This high logic-level signal on lead 316 is applied through a buffer 318 to the inputs of two of the AND-gates in the integrated circuit 283. The other inputs to these AND-gates are the signals on leads 284 and 286, which when present cause the fuel injectors to be energized in the manner previously described.

The signal on lead 316 is the output of one of the multivibrators in the dual monostable multivibrator 314 and is set, for example, for 100 ms. If a load signal does not occur as expected, the 100 ms multivibrator times out and a high logic-level signal results on lead 320. The second multivibrator in the dual monostable multivibrator 314 receives $I_r$ pulses on lead 112 and produces a two ms pulse on output lead 322 each time an $I_r$ pulse occurs on lead 112. The signals on leads 320 and 322 are applied to the inputs of the dual-input AND-gates in the integrated circuit 283 such that leads 292 and 294 are effectively connected to ground potential for two ms each time an $I_r$ pulse occurs on lead 112.

The engine control method described herein is specifically intended for use in a speed-density electronic fuel metering system. However, should it be desired to use a mass-flow system providing a signal directly indicative of the amount of air entering an internal combustion engine, the method of the invention may be used by employing a computer-generated binary number signal to form a product with a second electrical signal supplied directly to a multiplier, such as a rate multiplier hereinabove described. The direct input to the multiplier may be a signal having a PRF directly representative of a volumetric air flow into the engine, such as may be obtained from known vortex-shedding air meters, and the binary number electrical signal generated by the computer may represent factors necessary to convert a volumetric air flow signal to a mass air flow signal. Also, corrections may be made for delays in fuel delivery from the fuel metering system, much in the manner the injector offset correction was made in the preferred embodiment described herein.

In summary, the computer generated binary number electrical signal is used in conjunction with a signal directly supplied to multiplier means to produce product electrical signals continually, or at least at a rate greater than the rate at which the binary number electrical signal supplied by the digital computer is updated. This is particularly advantageous because it permits accurate engine fuel-metering control and because flexibility of engine control system design is possible and the control system can be applied to various engine types. The engine control system, although digital, is made to function much like an analog computer to improve engine operation during transient conditions. This is accomplished by supplying the rapidly-changing engine operating variables to the multiplier means as a factor to be multiplied by computer-generated and periodically updated coefficients.

Based upon the foregoing description of the invention, what is claimed is:

1. A method for controlling the amount of fuel metered, through electrically-controllable valve means, to an internal combustion engine, said method comprising the steps of:

generating a plurality of engine condition electrical signals, each of said signals being representative of a condition under which said engine is operating;

calculating a first coefficient value representing a first coefficient in a first product, said calculating of said first coefficient value being performed, using one or more of said engine condition electrical signals, by a digital computer programmed to calculate said first coefficient value from a function or functions describing a desired relationship between said first coefficient value and said one or more of said engine condition electrical signals;

calculating a second coefficient value representing a second coefficient in a second product, said calculating of said second coefficient value being performed, using one or more of said engine condition electrical signals, by a digital computer programmed to calculate said second coefficient value from a function or functions describing a desired relationship between said second coefficient value and said last-mentioned one or more of said engine condition electrical signals;

as outputs of said digital computer, making available said calculated first coefficient value as a first binary number electrical signal and said calculated second coefficient value as a second binary number electrical signal;

while said engine is in operation, continually repeating the above steps to effect changes in said first and second binary number electrical signals;

with an electrical circuit coupled between said digital computer and said electrically-controllable valve means and continuously or at a rate greater than the rate at which said repeating of the steps occurs, multiplying said first binary number electrical signal by a first of said engine condition electrical signals, thereby, obtaining a first product electrical signal, and multiplying said second binary number electrical signal by a second of said engine condition electrical signals, thereby, obtaining a second product electrical signal; and with said electrical circuit and said electrically-controllable valve means, determining the difference between said first and second product electrical signals and metering fuel to said engine in proportion to the difference between said first and second product electrical signals.

2. A method according to claim 1 wherein said engine includes an intake manifold and means for recirculating exhaust gases through said engine via said intake manifold and wherein said first of said engine condition electrical signals, by which said first binary number electrical signal is multiplied, is proportional to the flow rate of the mixture of air and exhaust gases in said intake manifold and wherein said second of said engine condition signals, by which said second binary number electrical signal is multiplied, is proportional to the flow rate of exhaust gases in said intake manifold.

3. A method according to claim 1 which includes the additional step of, with said electrical circuit, adding to the difference between said first and second product electrical signals an electrical signal representative of a characteristic of said electrically controllable valve means.

4. A method according to claim 1 wherein said first and second of said engine condition electrical signals, by which said first and second binary number electrical signals are multiplied, respectively, are used by said digital computer in the calculation of said first and second binary number electrical signals.

5. A method according to claim 1 wherein said electrical circuit includes a plurality of binary rate multipliers and an up/down counter, said first and second product electrical signals being obtained as the respective outputs of two of said binary rate multipliers and said difference between said first and second product electrical signals being obtained as a binary number count in said up/down counter, said first and second product electrical signals being supplied to said up/down counter.

6. Apparatus for controlling the amount of fuel metered to an internal combustion engine, said apparatus comprising:

electrically controllable means for controlling the rate at which fuel is metered to said engine;

means for generating a plurality of engine condition electrical signals, each of said signals being representative of a condition under which said engine is operating;

digital computer means:

1. for calculating a first coefficient value representing a first coefficient in a first product, said calculating of said first coefficient value being performed, using one or more of said engine condition electrical signals, by said digital computer means, said digital computer means being programmed to calculate said first coefficient value from a function or functions describing a desired relationship between said first coefficient value and said one or more of said engine condition electrical signals;
2. for calculating a second coefficient value representing a second coefficient in a second product, said calculating of said second coefficient value being performed, using one or more of said engine condition electrical signals, by said digital computer means, said digital computer means being programmed to calculate said second coefficient value from a function or functions describing a desired relationship between said second coefficient value and said last-mentioned one or more of said engine condition electrical signals;
3. for making available said calculated first coefficient value as a first binary number output electrical signal and said calculated second coefficient value as a second binary number output electrical signal; and
4. for repeating continually said calculating of said first and second coefficient values, thereby, to effect changes in said first and second binary number output electrical signals in response to changes in said engine condition electrical signals of which said first and second coefficient values are functions;

electrical circuit means, coupled between said digital computer means and said electrically controllable means for controlling the rate at which fuel is metered to said engine, for multiplying, continuously or at a rate greater than the rate at which said calculating of said first and second coefficient values by said digital computer means is repeated:

a. said first binary number output electrical signal by a first of said engine condition electrical signals, thereby, to obtain a first product electrical signal, and
b. said second binary number output electrical signal by a second of said engine condition electrical signals, thereby, to obtain a second product electrical signal; and said electrical circuit means including means for determining the difference between said first and second product electrical signals and for causing said electrically controllable means to meter fuel to said engine in proportion to the difference between said first and second product electrical signals.

7. Apparatus according to claim 6 wherein said engine includes an intake manifold and means for recirculating exhaust gases through said engine via said intake manifold and wherein said first of said engine condition electrical signals, by which said first binary number output electrical signal is multiplied, is proportional to the flow rate of the mixture of air and exhaust gases in said intake manifold and wherein said second of said engine condition electrical signals, by which said second binary number output electrical signals are multiplied, is proportional to the flow rate of exhaust gases in said intake manifold.

8. Apparatus according to claim 6 which includes circuit means for adding, to said difference between said first and second product electrical signals, in electrical signal representative of a characteristic of said electrically-controllable valve means.

9. Apparatus according to claim 6 wherein said first and second of said engine condition electrical signals, by which said first and second binary number output electrical signals are multiplier, respectively, are used by said digital computer means in the calculation of said first and second binary number output electrical signals.

10. Apparatus according to claim 6 wherein said electrical circuit includes a plurality of binary rate multipliers and an up/down counter, said first and second product electrical signals being obtained as the respective outputs of two of said binary rate multipliers and said difference between said first and second product electrical signals being obtained as a binary number count in said up/down counter, said first and second product electrical signals being supplied to said up/down counter.

* * * * *